US011143206B2

(12) United States Patent
Masuda

(10) Patent No.: US 11,143,206 B2
(45) Date of Patent: Oct. 12, 2021

(54) ROTARY MACHINE

(71) Applicant: MITSUBISHI HEAVY INDUSTRIES COMPRESSOR CORPORATION, Tokyo (JP)

(72) Inventor: Yuji Masuda, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 100 days.

(21) Appl. No.: 16/348,003

(22) PCT Filed: Nov. 8, 2016

(86) PCT No.: PCT/JP2016/083072
§ 371 (c)(1),
(2) Date: May 7, 2019

(87) PCT Pub. No.: WO2018/087808
PCT Pub. Date: May 17, 2018

(65) Prior Publication Data

US 2019/0285091 A1 Sep. 19, 2019

(51) Int. Cl.
*F04D 29/66* (2006.01)
*F04D 17/12* (2006.01)
(Continued)

(52) U.S. Cl.
CPC ..... *F04D 29/661* (2013.01); *F01D 5/027* (2013.01); *F01D 5/043* (2013.01); *F04D 17/12* (2013.01);
(Continued)

(58) Field of Classification Search
CPC .... F04D 29/668; F04D 29/666; F04D 29/661; F04D 29/051; F04D 29/056; F01D 5/10;
(Continued)

(56) References Cited

U.S. PATENT DOCUMENTS 4,044,628 A 8/1977 Jacks
4,743,174 A * 5/1988 Sato ..... F04D 25/06 417/365
(Continued)

FOREIGN PATENT DOCUMENTS

EP 1293657 A1 3/2003
JP S63-022301 U 2/1988
(Continued)

OTHER PUBLICATIONS

International Search Report Issued in Corresponding PCT Application No. PCT/JP2016/083072, dated Jan. 24, 2017 (4 Pages with English Translation).
(Continued)

*Primary Examiner* — Ninh H. Nguyen
(74) *Attorney, Agent, or Firm* — Osha Bergman Watanabe & Burton LLP

(57) ABSTRACT

A rotary machine includes: a pair of radial bearings for rotatably supporting a rotating shaft around a center axis; impellers fixed to the rotating shaft at positions separated from the radial bearings in a center axis direction; and additional masses fixed to the rotating shaft at positions separated from both the radial bearings and the impellers in the center axis direction, and applying a load to an entire circumference of the rotating shaft so as to move positions of amplitude increase regions where an amplitude in a radial direction of the rotating shaft starts to increase.

6 Claims, 4 Drawing Sheets

(51) Int. Cl.

| | |
|---|---|
| ***F04D 29/051*** | (2006.01) |
| ***F04D 29/056*** | (2006.01) |
| ***F04D 25/16*** | (2006.01) |
| ***F01D 5/02*** | (2006.01) |
| ***F01D 5/04*** | (2006.01) |

(52) U.S. Cl.
CPC ..... *F04D 25/163* (2013.01); *F04D 29/051* (2013.01); *F04D 29/056* (2013.01); *F04D 29/666* (2013.01); *F05D 2240/54* (2013.01); *F05D 2260/96* (2013.01)

(58) Field of Classification Search
CPC ..... F05D 2240/54; F05D 2260/4031; F05D 2260/96; F16F 7/00; F16F 15/12; F16C 15/00
See application file for complete search history.

(56) References Cited

U.S. PATENT DOCUMENTS

| | | | | |
|---|---|---|---|---|
| 5,090,668 | A * | 2/1992 | Hamada | F16F 15/1442 267/141 |
| 6,043,580 | A * | 3/2000 | Vogel | F04D 25/0606 310/179 |
| 6,390,789 | B1 * | 5/2002 | Grob | F04D 17/12 417/251 |
| 6,883,653 | B2 * | 4/2005 | Kato | F16F 15/1442 188/379 |
| 8,136,646 | B2 * | 3/2012 | Kuwayama | F16F 7/108 188/379 |
| 8,753,069 | B2 * | 6/2014 | Maier | F16C 39/06 415/104 |
| 9,624,936 | B2 * | 4/2017 | Johnsen | F04D 27/0223 |
| 2001/0050203 | A1 * | 12/2001 | Kuwayama | F16F 15/1442 188/379 |
| 2003/0080484 | A1 | 5/2003 | Kato et al. | |
| 2004/0241015 | A1 | 12/2004 | Loos | |

FOREIGN PATENT DOCUMENTS

| | | | |
|---|---|---|---|
| JP | 63-063501 | U | 4/1988 |
| JP | H01-298927 | A | 12/1989 |
| KR | 10-2016-0071275 | A | 6/2016 |

OTHER PUBLICATIONS

Written Opinion Issued in Corresponding PCT Application No. PCT/JP2016/083072, dated Jan. 24, 2017 (7 Pages with English Translation).
European Search Report in corresponding European Application No. 16921178.6, dated Jul. 22, 2019 (7 pages).

* cited by examiner

ROTARY MACHINE

TECHNICAL FIELD

The present invention relates to a rotary machine.

BACKGROUND ART

In general, a rotary machine includes a rotating shaft and an impeller fixed to the rotating shaft. As such a rotary machine including the impeller, for example, PTL 1 describes a turbine device provided with an impeller formed of a low-strength material.

Meanwhile, when a member having a constant mass similar to the impeller is fixed to the rotating shaft, the vibration is likely to occur in the rotating shaft when the rotating shaft rotates. Therefore, in the rotary machine, countermeasures against the vibration, such as supporting the rotating shaft by a radial bearing so as to suppress the vibration of the rotating shaft, are taken.

CITATION LIST

Patent Literature

[PTL 1] Japanese Unexamined Utility Model Application, First Publication No. S 63-63501

SUMMARY OF INVENTION

Technical Problem

However, depending on the positional relationship or the size of the impeller and the radial bearing, there is a possibility that the vibration cannot be sufficiently suppressed only by the radial bearing. Therefore, regardless of the impeller and the radial bearing, it is desired to suppress the vibration of the rotating shaft.

The present invention is to provide a rotary machine that can suppress the vibration of the rotating shaft regardless of the impeller and the radial bearing.

Solution to Problem

According to a first aspect of the present invention, there is provided a rotary machine including: a rotating shaft that rotates around a center axis by a rotation driving force input from an outside; a pair of radial bearings for rotatably supporting the rotating shaft around the center axis; a thrust bearing for restraining movement of the rotating shaft in a center axis direction; impellers fixed to the rotating shaft at a position separated from the radial bearing in the center axis direction, and integrally rotating with the rotating shaft; and additional masses fixed to the rotating shaft at positions separated from both the radial bearings and the impellers in the center axis direction, and applying a load to an entire circumference of the rotating shaft so as to move positions of amplitude increase regions where an amplitude in a radial direction of the rotating shaft starts to increase.

With such a configuration, the position of the amplitude increase region of the rotating shaft can be moved by the additional mass. Accordingly, the load in the radial direction from the rotating shaft to the radial bearing increases, and the rotating shaft can be supported by the radial bearing so as to effectively suppress the vibration of the rotating shaft.

In the rotary machine according to a second aspect of the present invention, in the first aspect, the impellers may be fixed to the rotating shaft on an outer side of the pair of the radial bearings in the center axis direction, and the additional mass may be fixed to the rotating shaft between the impeller in the center axis direction and the radial bearing.

When the impeller is provided at an end portion of the rotating shaft which projects to the outer side of the pair of radial bearings, the impeller is likely to vibrate. In such a configuration, when the additional mass is provided between the impeller and the radial bearing, the amplitude increase region of the rotating shaft moves in the vicinity of the radial bearing or on the inside of the radial bearing in the center axis direction. As a result, it is possible to effectively suppress the vicinity of the amplitude increase region of the rotating shaft by the radial bearing.

In the rotary machine according a third aspect of the present invention, in the first or second aspect, the additional mass may include a base portion fixed to an outer circumferential surface of the rotating shaft, a weight portion provided on an outer side in the radial direction with respect to the base portion, and a connection portion that connects the base portion and the weight portion to each other, the base portion may include an inner circumferential groove recessed from a center part in the center axis direction on an inner circumferential surface which is in contact with an outer circumferential surface of the rotating shaft, and a pair of contact portions that is in contact with the outer circumferential surface of the rotating shaft and is formed on both sides in the center axis direction with respect to the inner circumferential groove, and the connection portion may be formed at a position where the position in the center axis direction overlaps the inner circumferential groove.

According to such a configuration, when the additional mass integrally rotates with the rotating shaft, a centrifugal force generated by the weight portion is transmitted to the base portion via the connection portion. When the centrifugal force generated by the weight portion is transmitted to the base portion, a load is generated on the base portion so that the inner circumferential groove swells, and the contact portion is pressed against the rotating shaft. Accordingly, a frictional force generated between the contact portion and the rotating shaft increases, and the additional mass is firmly fixed to the rotating shaft.

In the rotary machine according to a fourth aspect of the present invention, in the third aspect, the connection portion may be formed so that the position in the center axis direction is separated from the pair of the contact portions.

With such a configuration, it is possible to suppress the centrifugal force generated by the weight portion from pressing only the contact portion on one side against the rotating shaft. Therefore, it is possible to prevent a fixing force of the contact portions on the both sides in the center axis direction of the inner circumferential groove with respect to the rotating shaft from varying.

In the rotary machine according to a fifth aspect of the present invention, in the third or fourth aspect, a length of the connection portion may be shorter than that of the weight portion in the center axis direction.

According to such a configuration, when the centrifugal force generated by the weight portion is intensively transmitted to the base portion via the connection portion. Therefore, it is possible to effectively use the centrifugal force generated by the weight portion and to press the contact portion against the outer circumferential surface of the rotating shaft.

In the rotary machine according to a sixth aspect of the present invention, in any one of the first to fifth aspects, the rotary machine may be a geared compressor including a driving gear rotationally driven by a driving source, and a driven gear to which rotation of the driving gear is transmitted and which is fixed to the rotating shaft, and the driven gear may be disposed on an inside of the pair of the radial bearings in the center axis direction.

In the rotary machine according to a seventh aspect of the present invention, in any one of the first to fifth aspects, the rotary machine may be a single-shift multistage centrifugal compressor in which a plurality of the impellers is disposed on an inside of the pair of the radial bearings in the center axis direction.

Advantageous Effects of Invention

According to the present invention, regardless of the impeller and the radial bearing, it is possible to suppress the vibration of the rotating shaft.

DESCRIPTION OF EMBODIMENTS

Hereinafter, a rotary machine of the present invention will be described with reference to the drawings.

Figure 1:
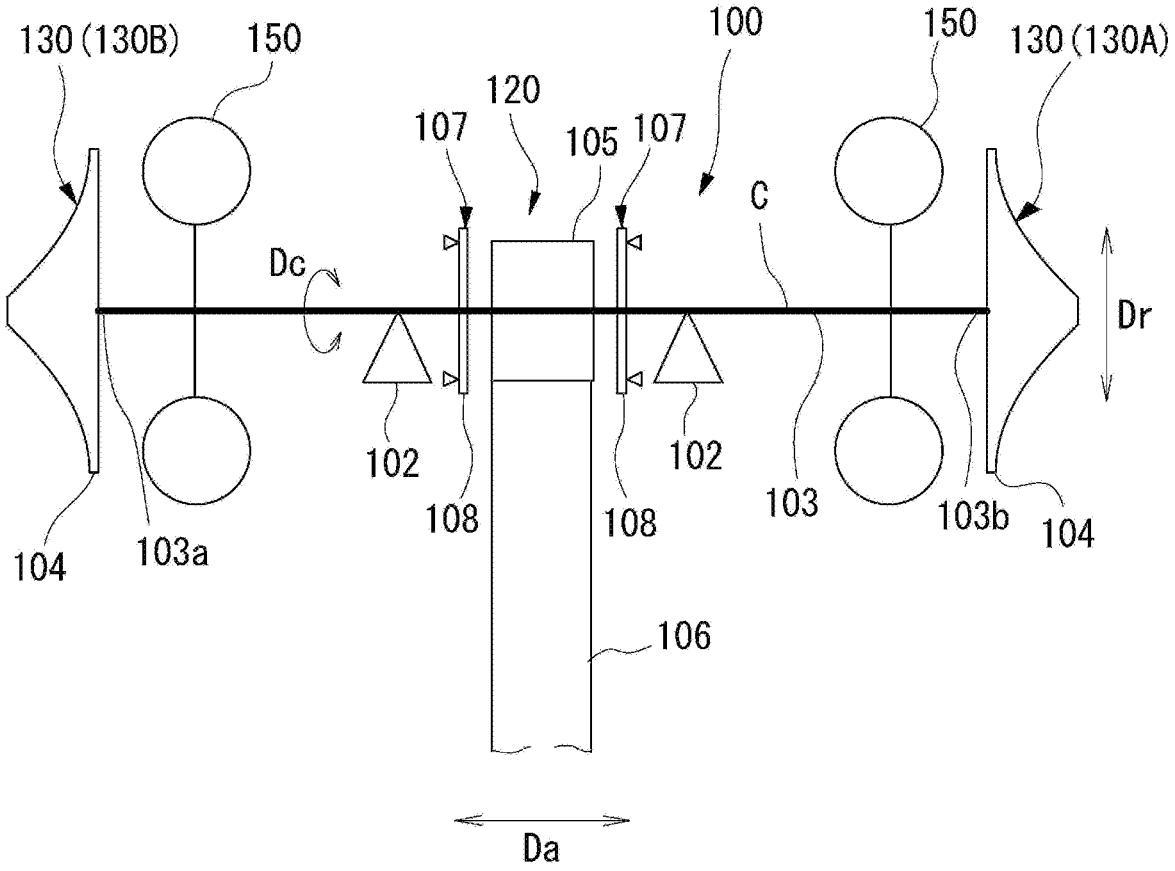
FIG. 1 is a view illustrating an overall configuration of a geared compressor according to an embodiment of the invention.
Figure 2:
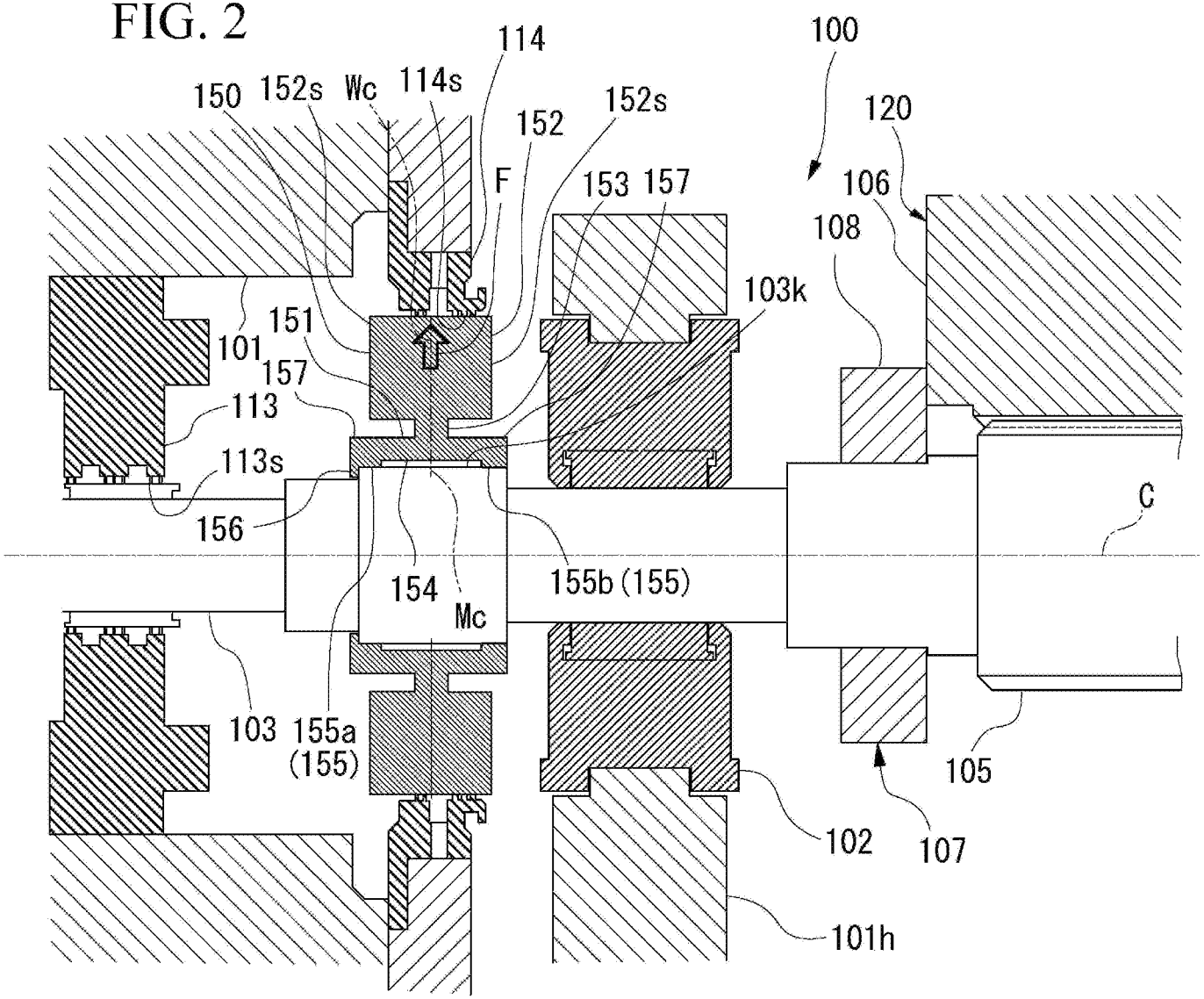
FIG. 2 is a sectional view illustrating a configuration of a main portion of the geared compressor according to the embodiment of the invention.

As illustrated in FIGS. 1 and 2, the rotary machine of the present embodiment is a geared compressor 100. The geared compressor 100 includes a casing 101 (refer to FIG. 2), a radial bearing 102, a rotating shaft 103, an impeller 104 (refer to FIG. 1), a pinion gear 105, a driving gear 106, a thrust bearing 107, and an additional mass 150.

In addition, hereinafter, the direction in which a center axis C of the rotating shaft 103 extends is defined as a center axis direction Da. A radial direction of the rotating shaft 103 with reference to the center axis C is simply defined as a radial direction Dr. In addition, a direction around the rotating shaft 103 around the center axis C is defined as a circumferential direction Dc.

The casing 101 (refer to FIG. 2) forms an outer shell of the geared compressor 100.

A pair of the radial bearings 102 is provided in the casing 101 at intervals in the center axis direction Da of the rotating shaft 103. The radial bearing 102 rotatably supports the rotating shaft 103 around the center axis C. In other words, the radial bearing 102 supports a load that acts in the radial direction Dr with respect to the rotating shaft. The radial bearing 102 is held by a bearing holding unit 101*h* formed integrally with the casing 101.

The rotating shaft 103 is made rotatable around the center axis C by a rotation driving force input from the outside. The rotating shaft 103 is rotatably supported by the pair of radial bearings 102 around the center axis C thereof. Both end portions 103*a* and 103*b* of the rotating shaft 103 protrude to both sides in the center axis direction Da from the pair of radial bearings 102.

A pinion gear (driven gear) 105 is fixed to the rotating shaft 103 between the pair of radial bearings 102. In other words, the pinion gear 105 is disposed on the inside of the pair of radial bearings 102 in the center axis direction Da. The pinion gear 105 meshes with the driving gear 106. Therefore, the rotation of the driving gear 106 is transmitted to the pinion gear 105.

The driving gear 106 is rotationally driven by an external driving source. The driving gear 106 is set to have a larger outer diameter than that of the pinion gear 105. Therefore, a rotational speed of the rotating shaft 103 having the pinion gear 105 is higher than the rotational speed of the driving gear 106.

The pinion gear 105 and the driving gear 106 configure a speed increase transmission unit 120 that increases the rotational speed of the driving gear 106 by the external driving source via the pinion gear 105 and transmits the rotational speed to the rotating shaft 103.

In addition, in the rotating shaft 103, the thrust bearing 107 is provided at a position separated from the pinion gear 105 in the center axis direction Da. The thrust bearing 107 is disposed on the inside of the pair of radial bearings 102 in the center axis direction Da. The thrust bearing 107 supports a load that acts in the center axis direction Da with respect to the rotating shaft 103 via a disc-shaped thrust collar 108 which projects the outer side of the rotating shaft 103 in the radial direction Dr. Therefore, the thrust bearing 107 restricts the movement of the rotating shaft 103 in the center axis direction Da.

As illustrated in FIG. 1, the impeller 104 is fixed to the rotating shaft 103 at a position separated from the radial bearing 102 in the center axis direction Da. The impeller 104 rotates integrally with the rotating shaft 103. The impeller 104 of the present embodiment is fixed to the rotating shaft 103 on the outer side of the pair of radial bearings 102 in the center axis direction Da. Specifically, the impeller 104 is provided at both the end portions 103*a* and 103*b* of the rotating shaft 103. Each of the impellers 104 is a bladed wheel having a plurality of blades in the circumferential direction Dc.

On the outer side of each of the impellers 104 in the radial direction Dr, the casing 101 is provided so as to cover the impeller 104 while opposing the inner circumferential surface. The casing 101 has an intake air passage (not illustrated) for taking air as a working fluid by communicating with the outside, and a spiral exhaust air passage (not illustrated) formed on the outer side in the radial direction Dr of the impeller 104.

The impeller 104 rotates integrally with the rotating shaft 103, and accordingly feeds the air taken in from the intake air passage (not illustrated) on the inside in the radial direction Dr to the exhaust air passage (not illustrated) on the outer side in the radial direction Dr. High-pressure air is supplied to an external device (not illustrated) through the exhaust air passage (not illustrated), and is used for various purposes.

With the impeller 104, the geared compressor 100 configures a pair of centrifugal compression units 130 disposed on both sides that interpose the speed increase transmission unit 120 therebetween. The pair of centrifugal compression units 130 includes a first-stage centrifugal compression unit 130A disposed on a first side interposing the speed increase transmission unit 120 and a second-stage centrifugal compression unit 130B disposed on a second side interposing the speed increase transmission unit 120. In other words, the geared compressor 100 is configured as a single-shift two-stage compressor.

In the geared compressor 100, the fluid compressed by the first-stage centrifugal compression unit 130A subsequently flows into the second-stage centrifugal compression unit 130B. In a course of flowing through the second-stage centrifugal compression unit 130B, the fluid is further compressed into a high-pressure fluid.

As illustrated in FIG. 2, a gas seal member 113 is provided in the casing 101 between the centrifugal compression unit 130 and the speed increase transmission unit 120. Specifically, the gas seal member 113 is disposed between the impeller 104 and the radial bearing 102 in the center axis direction Da. The gas seal member 113 is annular and fixed to the inner circumferential surface of the casing 101. A labyrinth seal portion 113*s* is formed on the inner circumferential surface of the gas seal member 113. The labyrinth seal portion 113*s* is brought into sliding contact with the outer circumferential surface of the rotating shaft 103, and accordingly reduces the leakage of the air from the centrifugal compression unit 130 side to the speed increase transmission unit 120 side.

As illustrated in FIG. 1, the additional mass 150 is fixed to the rotating shaft 103 at a position separated from the radial bearing 102, the impeller 104, and the thrust bearing 107 in the center axis direction Da. The additional mass 150 applies a load to the entire circumference of the rotating shaft 103. The additional mass 150 has a mass capable of moving the position of the amplitude increase region where the amplitude of the rotating shaft 103 in the radial direction Dr starts to increase. The mass of the additional mass 150 is determined in accordance with the mass of the rotating shaft 103 and the impeller 104 or the disposition of the impeller 104 with respect to the rotating shaft 103. Here, the amplitude increase region is a region that serves as a base point when the amplitude in the radial direction Dr increases in a two-dimensional curve shape in the rotating shaft 103.

A pair of additional mass 150 of the present embodiment is provided on the outer side of the pair of radial bearings 102 in the center axis direction Da. Specifically, the additional mass 150 is provided between the radial bearing 102 and the impeller 104. The additional mass 150 is provided at a position closer to the radial bearing 102 than the impeller 104 in the center axis direction Da with respect to the rotating shaft 103 in which the impeller 104 is provided in the end portion 103*a*. Further, specifically, the additional mass 150 is disposed between the radial bearing 102 and the gas seal member 113. Accordingly, the additional mass 150 moves the position of the amplitude increase region of the rotating shaft 103 to the inside in the center axis direction Da with respect to the position where the pair of radial bearings 102 is provided.

As illustrated in FIG. 2, the additional mass 150 has a cylindrical shape as a whole. The additional mass 150 is fixed in a state where the rotating shaft 103 is inserted thereinto. The additional mass 150 equally applies the load to the entire circumference of the rotating shaft 103.

The additional mass 150 integrally includes a base portion 151 to which the outer circumferential surface and the inner circumferential surface of the rotating shaft 103 are fixed, a weight portion 152 disposed on the outer side of the base portion 151 in the radial direction Dr, and a connection portion 153 that connects the base portion 151 and the weight portion 152 to each other.

The base portion 151 has a cylindrical shape that extends in the center axis direction Da of the rotating shaft 103. The base portion 151 has an inner circumferential groove 154 recessed from the inner circumferential surface toward the outer side in the radial direction Dr and a pair of contact portions 155 which is in contact with the outer circumferential surface of the rotating shaft 103.

The inner circumferential groove 154 is recessed on the outer side in the radial direction Dr at the center part in the center axial direction Da on the inner circumferential surface. The inner circumferential groove 154 is continuously formed in the circumferential direction Dc over the entire circumference of the inner circumferential surface. The inner circumferential groove 154 is formed only at the center part in the center axial direction Da on the inner circumferential surface of the base portion 151.

The contact portion 155 forms the inner circumferential surface of the base portion 151. The contact portion 155 is formed on both sides in the center axis direction Da with respect to the inner circumferential groove 154. By the contact portion 155, the base portion 151 is shrunk-fit over the entire circumference with respect to the outer circumferential surface of the rotating shaft 103.

Here, the rotating shaft 103 is formed with a radially expanded portion 103*k* which is radially expanded to the outer side in the radial direction Dr in regions opposing the inner circumferential groove 154 and the contact portions 155 on both sides thereof. In the additional mass 150, the contact portion 155 is fixed to the outer circumferential surface of the rotating shaft 103 by press-fitting the radially expanded portion 103*k* on the inside of the contact portion 155.

The contact portion 155 of the present embodiment includes a first contact portion 155*a* on the impeller 104 side in the center axis direction Da (outer side in the center axis direction Da) and a second contact portion 155*b* on the radial bearing 102 side in the center axis direction Da (inside in the center axis direction Da).

In the base portion 151, an inner circumferential flange portion 156 that protrudes to the inside of the first contact portion 155*a* in the radial direction Dr is integrally formed at the end portion on the impeller 104 side. The inner circumferential flange portion 156 restrains the movement of the additional mass 150 to the radial bearing 102 side in the center axis direction Da by abutting against the radially expanded portion 103*k* of the rotating shaft 103 from the center axis direction Da.

The weight portion 152 is formed on the outer side in the radial direction Dr with respect to the inner circumferential groove 154 of the base portion 151 and the contact portions 155 on both sides thereof. The weight portion 152 has a cylindrical shape that extends in the center axis direction Da of the rotating shaft 103. The weight portion 152 has a larger mass than that of the base portion 151. The weight portion 152 is formed to be longer in the radial direction Dr than the base portion 151. The weight portion 152 is formed to be shorter in the center axis direction Da than the base portion 151. The weight portion 152 is disposed at a position where a center We in the center axis direction Da overlaps a center Mc in the center axial direction Da of the inner circumferential groove 154.

A seal member 114 fixed to the inner circumferential surface of the casing 101 is provided on the outer side of the weight portion 152 in the radial direction Dr. The seal member 114 has a labyrinth seal portion 114*s* on the inner circumferential surface thereof and the labyrinth seal portion

114*s* is in sliding contact with the outer circumferential surface of the weight portion 152.

The connection portion 153 has a smaller mass than that of the base portion 151 and the weight portion 152. The connection portion 153 is formed to be shorter in the radial direction Dr than the base portion 151 and the weight portion 152. The connection portion 153 is formed to be shorter in the center axis direction Da than the base portion 151 and the weight portion 152. The length of the connection portion 153 in the center axis direction Da is formed to be shorter than the length of the inner circumferential groove 154 in the center axial direction Da. The connection portion 153 is formed at a position where the position in the center axis direction Da overlaps with the inner circumferential groove 154. The connection portion 153 is formed at a position separated from the first contact portion 155*a* and the second contact portion 155*b*. In other words, the connection portion 153 is disposed so as to be interposed by the first contact portion 155*a* and the second contact portion 155*b* in the center axis direction Da.

The connection portion 153 of the present embodiment is disposed at a position along the center We of the weight portion 152 and the center Mc of the inner circumferential groove 154. The connection portion 153 is formed by continuously forming slits 157 that are respectively recessed to the inside in the center axis direction Da from the side surfaces 152*s* on both sides of the weight portion 152 in the center axis direction Da over the entire circumference in the circumferential direction Dc.

According to the geared compressor 100 of the above-described embodiment, the additional mass 150 moves the position of the amplitude increase region of the rotating shaft 103 near the position where the radial bearing 102 is disposed. Therefore, the amplitude of the rotating shaft 103 at the position where the radial bearing 102 is disposed increases. Accordingly, the load in the radial direction Dr from the rotating shaft 103 to the radial bearing 102 increases, and the rotating shaft 103 can be supported by the radial bearing 102 so as to effectively suppress the vibration of the rotating shaft 103. Therefore, even in a state where the position of the radial bearing 102 or the position of the impeller 104 is fixed, the vibration of the rotating shaft 103 is suppressed. Accordingly, regardless of the radial bearing 102 and the impeller 104, the vibration of the rotating shaft 103 can be suppressed.

In addition, when the impeller 104 is provided in the end portion of the rotating shaft 103 that protrudes to the outer side of the pair of radial bearings 102, the vibration of the rotating shaft 103 on the outer side of the radial bearing 102 in the center axis direction Da is likely to increase. However, the additional mass 150 is provided further on the radial bearing 102 side than the end portion 103*a* of the rotating shaft 103 provided with the impeller 104. Therefore, the additional mass 150 moves the amplitude increase region of the rotating shaft 103 in the vicinity of the radial bearing 102 or on the inside of the radial bearing 102 in the center axis direction Da. As a result, it is possible to effectively suppress the vicinity of the amplitude increase region of the rotating shaft 103 by the radial bearing 102. Accordingly, even in a state where the position of the radial bearing 102 or the position of the impeller 104 is fixed, the vibration of the rotating shaft 103 can be effectively suppressed.

Further, the additional mass 150 connects the base portion 151 and the weight portion 152 to each other by the connection portion 153 that extends in the radial direction. Therefore, when the additional mass 150 integrally rotates with the rotating shaft 103, a centrifugal force F generated by the weight portion 152 is transmitted to the base portion 151 via the connection portion 153. In particular, the connection portion 153 is disposed at the center We of the weight portion 152 and the center Mc of the inner circumferential groove 154. Therefore, the centrifugal force F that acts on the weight portion 152 transmitted to the base portion 151 acts in the vicinity of the center Mc of the inner circumferential groove 154, and the vicinity of the center portion of the base portion 151 in the center axis direction Da is pulled to the outer side in the radial direction Dr. As a result, a load is generated in the base portion 151 so that the inner circumferential groove 154 swells, and the first contact portion 155*a* and the second contact portion 155*b* are respectively pressed against the radially expanded portion 103*k* of the rotating shaft 103. Accordingly, a frictional force generated between the first contact portion 155*a* and the second contact portion 155*b* and the rotating shaft 103 increases, and the additional mass 150 is firmly fixed to the rotating shaft 103.

Further, the position of the connection portion 153 in the center axis direction Da is separated from each of the first contact portion 155*a* and the second contact portion 155*b*. Therefore, it is possible to suppress the centrifugal force F generated by the weight portion 152 from being partially pressed against the rotating shaft 103 only on one side of the first contact portion 155*a* and the second contact portion 155*b*. Therefore, it is possible to prevent a fixing force of the first contact portion 155*a* and the second contact portion 155*b* on the both sides in the center axis direction Da of the inner circumferential groove 154 with respect to the rotating shaft 103 from varying.

Further, the width of the connection portion 153 in the center axis direction Da is smaller than that of the weight portion 152. According to such a configuration, when the centrifugal force F generated by the weight portion 152 is intensively transmitted to a region connected to the connection portion 153 of the base portion 151. Accordingly, it is possible to effectively use the centrifugal force F generated by the weight portion 152, and to press the first contact portion 155*a* and the second contact portion 155*b* against the outer circumferential surface of the rotating shaft 103. As a result, the additional mass 150 is firmly fixed to the rotating shaft 103.

Modification Example of Embodiment

Figure 3:
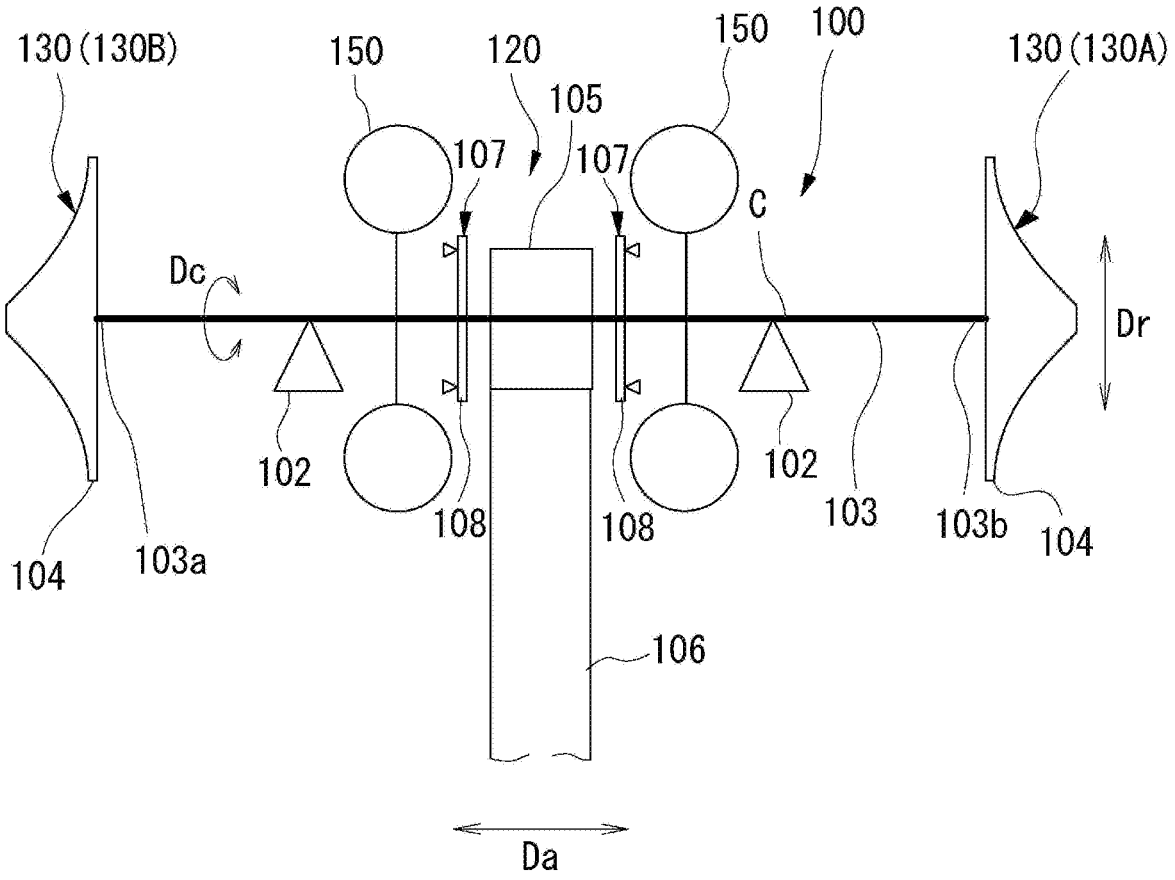
FIG. 3 is a view illustrating an overall configuration of a modification example of the geared compressor according to the embodiment of the invention.

In the present embodiment, the additional mass 150 is disposed on both outer sides of the pair of radial bearings 102, but the present invention is not limited thereto. For example, as illustrated in FIG. 3, the additional mass 150 may be provided on the inside of the pair of radial bearings 102 and on the outer side in the center axis direction Da with respect to the pinion gear 105.

Above, although the embodiment of the present invention has been described in detail with reference to the drawings, the respective configurations and combinations thereof in the embodiment are merely examples, and additions, omissions, substitutions, and other changes of configurations are possible within the scope not departing from the gist of the present invention. In addition, the present invention is not limited by the embodiment, but is limited only by the claims.

For example, in the above-described embodiment, as an aspect of the geared compressor 100, a so-called single-shift two-stage configuration is described as an example. However, the aspect of the geared compressor 100 is not limited thereto, and a two-shift four-stage configuration or a configuration having more shifts and more stages may be provided in accordance with design and specifications. Regardless of the configuration, the centrifugal compression unit 130 of each stage can obtain the same operational effect as described in the above-described embodiment.

Further, the rotary machine of the present invention is not limited to the geared compressor 100. The rotary machine can also be applied to a single-shift multistage centrifugal compressor of a type in which the rotating shaft 103 is directly rotationally driven by the external driving source.

Figure 4:
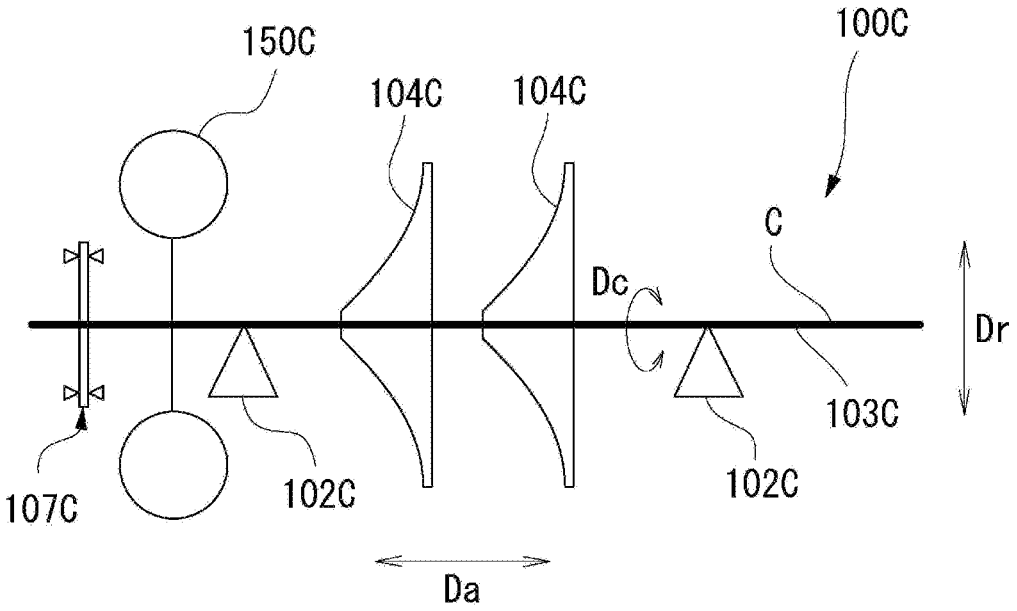
FIG. 4 is a view illustrating an overall configuration of a centrifugal compressor which is a modification example of a rotary machine according to the embodiment of the invention.

For example, as illustrated in FIG. 4, a single-shift multistage centrifugal compressor (rotary machine) 100C of a type in which a rotating shaft 103C is directly rotationally driven by an external driving source includes the rotating shaft 103C that is rotatably supported by a pair of radial bearings 102C, a plurality of impellers 104C provided in the rotating shaft 103C between the one pair of radial bearings 102C, and a thrust bearing 107C for restraining movement of the rotating shaft 103C in the center axis direction Da.

In the single-shift multistage centrifugal compressor 100C, the additional mass 150C similar to the above-described embodiment is provided in the rotating shaft 103C at a position on the outer side of the pair of radial bearings 102C, that is, at a position on the inside of the thrust bearing 107C in the center axis direction Da.

In such a configuration, by providing the additional mass 150C, it is possible to move the position of the amplitude increase region of the rotating shaft 103C near the position where the radial bearing 102C is disposed from the position where the impeller 104C is disposed. Accordingly, the load in the radial direction Dr from the rotating shaft 103C to the radial bearing 102C is generated, and the rotating shaft 103C can be supported by the radial bearing 102C so as to effectively suppress the vibration of the rotating shaft 103C. Therefore, it is possible to effectively suppress the vibration of the rotating shaft 103C.

Figure 5:
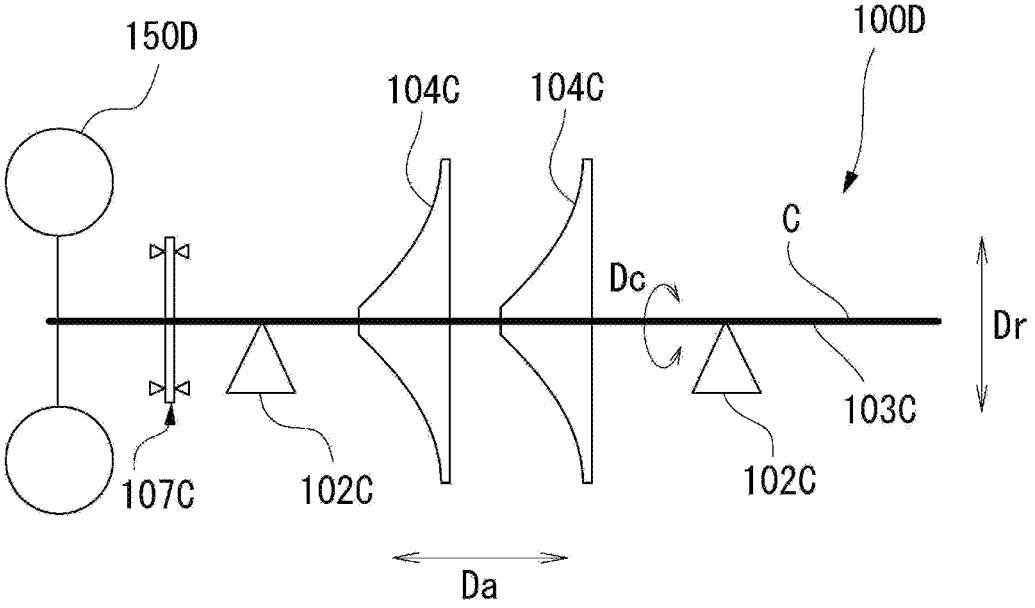
FIG. 5 is a view illustrating an overall configuration of another modification example of the centrifugal compressor which is the modification example of the rotary machine according to the embodiment of the invention.

In addition, a single-shift multistage centrifugal compressor (rotary machine) 100D illustrated in FIG. 5 includes the rotating shaft 103C that is rotatably supported by the pair of radial bearings 102C, the plurality of impellers 104C provided in the rotating shaft 103C between the pair of radial bearings 102C, and the thrust bearing 107C for restraining movement of the rotating shaft 103C in the center axis direction Da.

In the single-shift multistage centrifugal compressor 100D, an additional mass 150D similar to that in the above-described embodiment is provided in the rotating shaft 103C at a position on the outer side of the pair of radial bearings 102C, that is, at a position on the outer side of the thrust bearing 107C in the center axis direction Da.

Even with such a configuration, similar to the above-described embodiment, it is possible to effectively suppress the vibration of the rotating shaft 103C.

INDUSTRIAL APPLICABILITY

According to the above-described rotary machine, regardless of the impeller and the radial bearing, it is possible to suppress the vibration of the rotating shaft.

REFERENCE SIGNS LIST

100 Geared compressor (rotary machine)
100C, 100D Single-shift multistage centrifugal compressor (rotary machine)
101 Casing
101*h* Bearing holding unit
102, 102C Radial bearing
103, 103C Rotating shaft
103*a* End portion
103*k* Radially expanded portion
104, 104C Impeller
105 Pinion gear (driven gear)
106 Driving gear
107, 107C Thrust bearing
108 Thrust collar
113 Gas seal member
113*s* Labyrinth seal portion
114 Seal member
114*s* Labyrinth seal portion
120 Speed increase transmission unit
130 Centrifugal compression unit
130A, 130B Centrifugal compression unit
150, 150C, 150D Additional mass
151 Base portion
151*a* Center portion
152 Weight portion
152*s* Side surface
153 Connection portion
154 Inner circumferential groove
155 Contact portion
155*a* First contact portion
155*b* Second contact portion
156 inner circumferential flange portion
157 Slit
C Center axis
F Centrifugal force
Mc Center
We Center

The invention claimed is:

1. A rotary machine comprising:

a rotating shaft that is configured to rotate around a center axis by a rotation driving force input from an outside;

a pair of radial bearings for rotatably supporting the rotating shaft around the center axis;

a thrust bearing for restraining movement of the rotating shaft in a center axis direction;

impellers that integrally rotate with the rotating shaft and are fixed to outermost positions of the rotating shaft, in the center axis direction, at positions separated from the radial bearings in the center axis direction, wherein the radial bearings are arranged only at positions sandwiched between the impellers in the center axis direction; and a pair of additional masses that are each fixed to the rotating shaft at a position separated from both the radial bearings and the impellers in the center axis direction, and that each apply a load to an entire circumference of the rotating shaft so as to move a position of an amplitude increase region where an amplitude in a radial direction of the rotating shaft starts to increase, wherein the impellers are fixed to the rotating shaft on outer sides of the pair of the radial bearings in the center axis direction, each of the pair of the additional masses is fixed to the rotating shaft between one of the impellers and one of the radial bearings in the center axis direction, and the thrust bearing supports a load that acts in the center axis direction with respect to the rotating shaft via a disc-shaped thrust collar that projects an outer side of the rotating shaft in the radial direction and the thrust bearing is disposed on an inside of the pair of the radial bearings in the center axis direction.

2. The rotary machine according to claim 1,
wherein the additional mass includes
a base portion fixed to an outer circumferential surface of the rotating shaft,
a weight portion provided on an outer side in the radial direction with respect to the base portion, and
a connection portion that connects the base portion and the weight portion to each other,
wherein the base portion includes
an inner circumferential groove recessed from a center part in the center axis direction on an inner circumferential surface of the base portion which is in contact with an outer circumferential surface of the rotating shaft, and
a pair of contact portions that is in contact with the outer circumferential surface of the rotating shaft and is formed on both sides in the center axis direction with respect to the inner circumferential groove, and
wherein the connection portion is formed at a position where the position in the center axis direction overlaps the inner circumferential groove.

3. The rotary machine according to claim 2,
wherein the connection portion is formed so that the position in the center axis direction is separated from the pair of the contact portions.

4. The rotary machine according to claim 3,
wherein a length of the connection portion is shorter than that of the weight portion in the center axis direction.

5. The rotary machine according to claim 2,
wherein a length of the connection portion is shorter than that of the weight portion in the center axis direction.

6. The rotary machine according to claim 1,
wherein the rotary machine is a geared compressor including
a driving gear configured to be rotationally driven by a driving source, and
a driven gear to which rotation of the driving gear is transmitted and which is fixed to the rotating shaft, and
wherein the driven gear is disposed on the inside of the pair of the radial bearings in the center axis direction.

* * * * *